US006018614A

United States Patent [19]

Garcia et al.

[11] Patent Number: 6,018,614

[45] Date of Patent: Jan. 25, 2000

[54] PORTABLE COMPRESSED AIR HEATER SYSTEM

[75] Inventors: Robert Michael Garcia, Laguna Hills; Thomas Donald Emery, Moreno Valley, both of Calif.

[73] Assignee: Northrop Grumman Corporation, Los Angeles, Calif.

[21] Appl. No.: 09/303,111

[22] Filed: Apr. 30, 1999

[51] Int. Cl.[7] ..... A45D 20/10

[52] U.S. Cl. ..... 392/383; 219/533; 432/222

[58] Field of Search ..... 432/219, 222, 432/224; 219/386, 520, 522, 533; 392/379, 383, 384

[56] References Cited

U.S. PATENT DOCUMENTS

| | | | |
|---|---|---|---|
| 3,681,567 | 8/1972 | Boecher | 219/365 |
| 4,081,238 | 3/1978 | Briggs et al. | 432/222 |
| 4,244,349 | 1/1981 | Velie et al. | 432/222 |
| 4,313,417 | 2/1982 | Briggs et al. | 432/222 |
| 4,517,038 | 5/1985 | Miller | 156/98 |
| 4,652,319 | 3/1987 | Hammond | 156/94 |
| 5,078,821 | 1/1992 | Garvey et al. | 156/282 |
| 5,374,388 | 12/1994 | Frailey | 264/510 |
| 5,922,227 | 7/1999 | McMurtrie | 219/220 |

*Primary Examiner*—John A. Jeffery
*Assistant Examiner*—Gregory A. Wilson
*Attorney, Agent, or Firm*—Terry J. Anderson; Karl J. Hoch, Jr.

[57] ABSTRACT

A portable compressed air heating system for delivering a flow of heated air directed at a substrate. The system first includes a hot air distribution member for placement in juxtaposition with the substrate and thereafter distributing heated air collected from a heater module. Second, the system includes a heater module for receiving and heating a continuous volume of air, and is equipped with an adjustable velocity production element for drawing and delivering heated air to the hot air distribution member. An interface conduit connects the heater module to a system controller disposed upstream therefrom, and includes circuitry directed by the controller for operation of the heating module. The system controller includes an air-in port for receiving air, an air-out port for distributing air, a heater-power conduit, a temperature controller, an air pressure monitor, and an air pressure adjuster.

11 Claims, 2 Drawing Sheets

PORTABLE COMPRESSED AIR HEATER SYSTEM

CROSS-REFERENCE TO RELATED APPLICATIONS (Not Applicable)

STATEMENT RE: FEDERALLY SPONSORED RESEARCH/DEVELOPMENT (Not Applicable)

FIELD OF THE INVENTION

This invention relates in general to high temperature heat delivery devices, and in particular to a portable compressed air heater system wherein high velocity hot air is delivered to a site by a heater module operating in cooperation with a hot air distribution member while air supply and system operational parameters are monitored and controlled by a programmable system controller in communication through an interface conduit with the heater module.

BACKGROUND OF THE INVENTION

Many chemical reactions require the administration of heat in order to expedite as well as complete such reactions to accomplish total product yield. While heat availability generally is not a problem where a usual site such as a laboratory is the location for performing a particular reaction, such heat availability may not be readily attainable where an on-site reaction is required to accomplish a repair or the like involving chemical reactivity between two or more reactants to produce a particular end product. A common chemical reaction that requires on-site and thus remote heat application is that wherein a curing step occurs which is heat dependent and which involves the repair of a structure by patching or otherwise depositing non-cured repair material at a damage site and thereafter curing the repair material to thereby integrally and structurally blend it with surrounding original material and produce a sound end product. A non-limiting example of such repair requirements is found in the maintenance of aircraft where skin and other components must be repaired as they occur, irrespective of location.

Present approaches to providing adequate heat at remote sites generally include nozzle-type electrical-resistance heaters or electrical-resistance heating blankets. The nozzle-type heaters generally have no significant operation monitoring, safety, or malfunction alarm elements, and provide a very small application footprint (e.g. three to six inch diameter) of hot air. The heating blankets likewise generally provide no significant monitoring or control parameters, and additionally require direct contact of an electrical device with a substrate during a rather lengthy time period to accomplish adequate heat radiation into the repaired member. Thus, despite the relatively wide-spread call for the remote application of heat in order to accomplish repair duties, a need is present for a portable heating system that can safely and in a regulatable manner deliver heating to a reaction site for chemical reaction completion. Accordingly, a primary object of the present invention is to provide a portable heating system wherein hot compressed air is produced and directed at a site of need for reactant interaction.

Another object of the present invention is to provide a portable heating system wherein a controller module operates, and monitors operation of, a heater module for both functionality and safety.

Yet another object of the present invention is to provide a portable heating system wherein a heat distribution member thereof can apply high-velocity hot air over a substrate surface dimension as great as about four square feet to thereby accomplish temperature management and produce a reactant-efficient environment.

These and other objects of the present invention will become apparent throughout the description thereof which now follows.

SUMMARY OF THE INVENTION

The present invention is a portable compressed air heating system for delivering a flow of heated air directed at a substrate. The system comprises, first, a hot air distribution member for placement in juxtaposition with the substrate to be heated and thereafter distributing heated air collected from a heater module disposed upstream and with which the distribution member is in airflow communication. Second, the system includes a heater module having at least one heating element for receiving and heating a continuous volume of air, and has an adjustable velocity production element for drawing and delivering heated air to the hot air distribution member. A conventional interface conduit connects the heater module to a programmable system controller disposed upstream therefrom. This interface conduit comprises a temperature monitoring circuit in communication with the interior of the heater module, an air intake circuit for receiving exterior air, an air outlet circuit for delivering air to be heated to the heater module, an air pressure monitoring circuit in communication with the adjustable velocity production element, an air pressure adjuster circuit in communication with the adjustable velocity production element, and a power circuit for carrying electricity to the heater module. Finally, the programmable system controller, in communication with the heater module via the interface conduit, includes an air-in port for receiving air from the air intake circuit of the interface conduit and an air-out port for distributing air through the air outlet circuit thereof. A heater-power conduit of the controller distributes electricity through the power circuit to the heater module, while a temperature controller measures and adjusts the temperature of the interior of the heater module. The controller additionally provides an air pressure monitor for measuring the air pressure of air departing the heater module for the hot air distribution member, and an air pressure adjuster for regulating the velocity and pressure of the air so departing the heater module.

Preferably, portability of the present heating system provides that the system controller fits within a standard suitcase that additionally can accommodate the heater module as well as the interface conduit for storage when the system is not in use. Likewise, the heat distribution member can also be accommodated in a second suitcase of like size to thereby provide two-piece portability for the entire heating system. Preferred additional safety and monitoring components include an explosion-proof housing for the heater module, a high-temperature audio alarm, circuit breaker protection, metering and adjustment capabilities of power, temperature, air-flow, and pressure parameters, and inclusion of an integrated process-temperature data logger. The system controller is programmable to automatically operate the heating system within established parameters and provide warning alerts when established parameters are exceeded. In this manner, a truly portable compressed air heating system incorporates a controller, a heater assembly, and a heat distribution member into one processing system.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
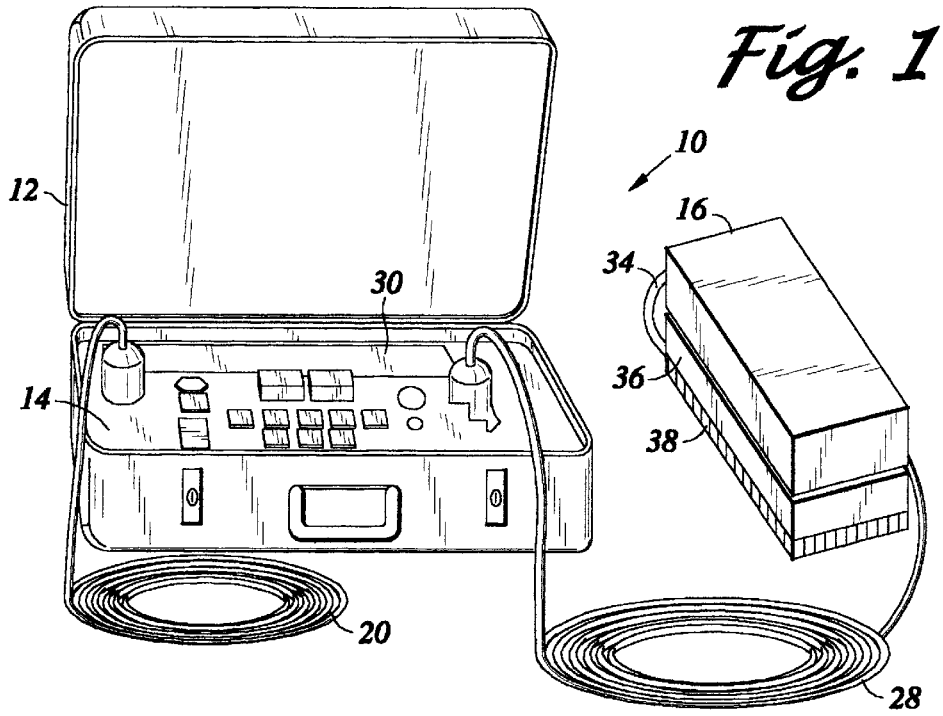
FIG. 1 is a perspective view of a portable compressed air heating system.
Figure 3:
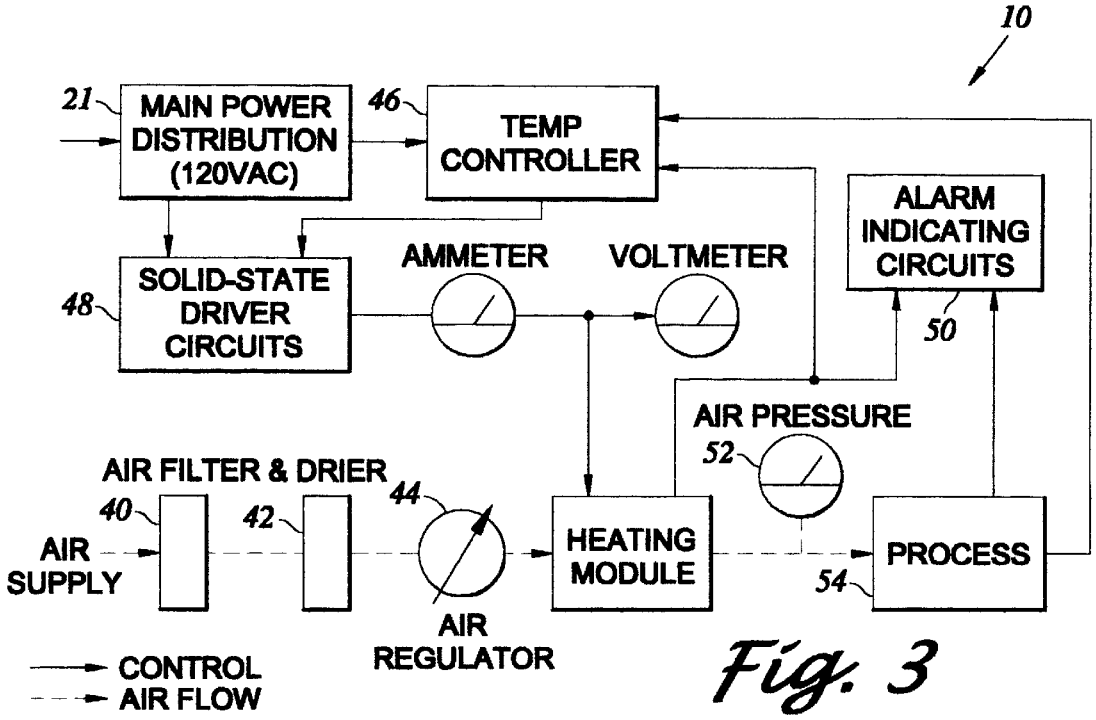
FIG. 3 is a block diagram of the heating system of FIG. 1.
Figure 2:
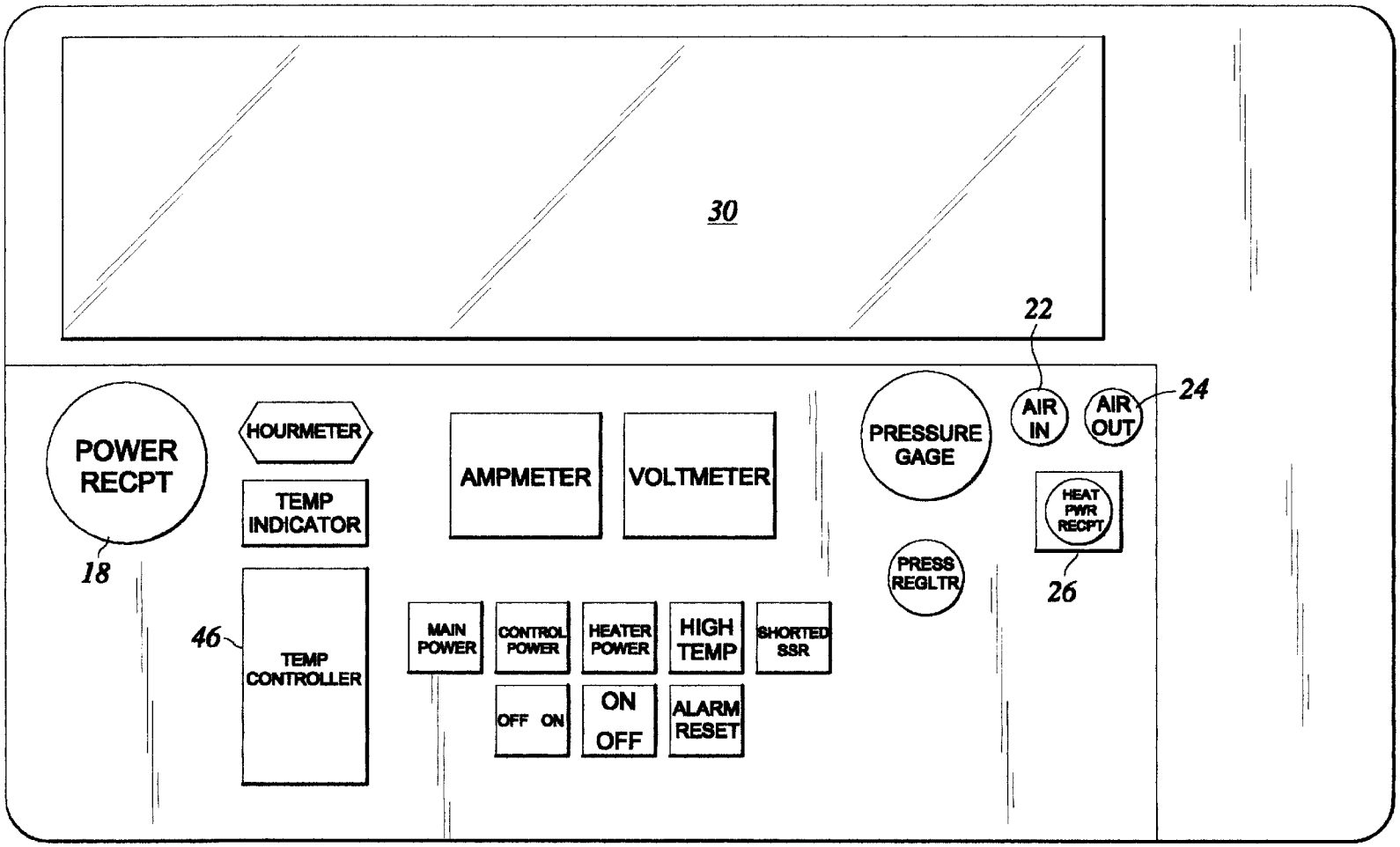
FIG. 2 is a top plan view of the system controller of the heating system of FIG. 1.

Referring to FIGS. 1–3, a portable compressed air heating system 10 is shown. Portability of the system 10 is exemplified in that a conventional 24-inch suitcase 12 houses a programmable system controller 14 for system operation as well as storing a heater module 16 when not in use. As is illustrated in FIG. 1 and more directly defined in FIGS. 2 and 3, the controller 14 includes a power receptacle 18 into which a standard 110 v power cord can be plugged to provide all power for the system 10. As specifically shown in FIG. 2 with labeled and thus self-explanatory control levers, standard switches are provided as recognized in the art for conventionally activating, controlling, and adjusting the system 10 through the controller 14. Standard gages include an ammeter, a voltmeter, a pressure gage, a temperature indicator and related temperature controller for the heating module 16, and a timer, all as labeled in FIG. 2. The controller 14 is typically programmable to automatically operate and monitor the heating system 10 within chosen and programmed parameters as would be recognized in the art.

As illustrated in FIGS. 1–3, the controller 14 is provided with an air-in port 22, an air-out port 24, and a heater power receptacle 26, all engaged by an interface conduit 28 as shown in FIG. 1 in a coiled configuration. When the system 10 is in operation, the interface conduit 28 leads from the controller 14 to the heater module 16, and carries a plurality of circuitry, driven by standard solid-state driver circuits, including: (1) a temperature monitoring circuit in contact with the heater module 16 for measuring the temperature of the interior of the heater module 16 and in communication with a temperature controller 46 (FIG. 3) and alarm indicating circuit 50 (FIG. 3); (2) an air intake circuit for drawing exterior air to the controller 14; (3) an air outlet circuit for delivering air to be heated to the heater module 16; (4) an air pressure adjuster circuit for regulating hot air velocity departing the heater module 16; (5) an air pressure monitoring circuit in communication with the air outlet circuit for reporting pressurization of delivered air; and (6) a power circuit for carrying electricity to the heater module 16. The controller 14 is provided internally with an integrated standard data logger for recording processing temperatures as would be recognized in the art.

FIG. 1 includes the heater module 16 operably connected to the controller 14 through the interface conduit 28. The interface conduit 28 can be as long as about 20 feet to thereby permit convenient positioning of the controller 14 a distance from a heat application site. The heater module 16 itself does not contact a substrate directly to administer a hot air flow, but instead is connected through an airflow tube 34 to a hot air distribution member such as a conventional manifold 36 having a plurality of standard tubular openings 38 through which hot air flows externally for juxtapositioning with a substrate destined for heat application. The manifold 36 preferably is of a size up to about four square feet to thereby effectuate a heat delivery area of substantially the same area. When not in use, the heater module 16 can be stored in a compartment 30 constructed in the panel structure 32 of the controller 14 and therefore within the suitcase 12. Heater module construction preferably includes a standard explosion proof housing and a plurality of conventional individual electrical-resistance heater cores therewithin such that a 110 volt power supply can be used. In particular, each core can be, for example, 800 watts, while three such cores provide 2.4 kilowatts to the heater module 16 while each core is operated on only a 110 volt power supply. Preferably, the heater module 16 has adequate core availability to produce heated air having a temperature up to about 600° F. The above-noted temperature monitoring circuit in contact with the heater module 16 measures the temperature of the interior of the heater module 16 as a safety precaution, and activates the controller 14 to sound an audible alarm if a heater module temperature exceeds a set maximum permissible temperature. Heated air departing the heater module 16 flows therefrom through standard adjustable Venturi openings as known in the art to thereby regulate air pressure velocity production in drawing and delivering heated air.

In operation, and as particularly illustrated in FIGS. 2 and 3, the heating system 10 is first activated through electricity conventionally delivered via the power cord 20 and main power distribution component 21 to thereby energize the entire system 10 including the controller 14 and the heater cores, via the power circuit of the interface conduit 28, of the heater module 16. Specifically-activated components of the controller 14 include a standard temperature controller 46 for setting, measuring, and maintaining a temperature, and standard solid-state driver circuits 48. The latter operate the system 10 including the heater module 16, provide ammeter and voltmeter gage readings, and adjust temperature values in accord with information transmitted by the temperature controller 46. Air is drawn into the controller 14 through the air-in port 22 through a standard filter 40 and drier 42 with velocity regulation controlled by a standard air regulator valve 44, and thereafter is directed through the air-out port 24 to the heater module 16. The temperature of the heater module 16 is monitored and is transmitted to both the temperature controller 46 and the alarm indicating circuit 50, thereby providing input for both temperature control and activation of an audible warning signal as earlier noted if the temperature exceeds a selected safe level. Heated air departing the heater module 16 flows therefrom through standard Venturi openings adjustable via the air pressure adjuster circuit to regulate air velocity and pressure as reported by a standard air pressure gage 52 and into the airflow tube 34, preferably of a standard quick-disconnect design, leading to the manifold 36. The manifold 36 is disposed on a substrate to be heated for the cure process 54 and, as earlier related, can be sized up to about four square feet to thereby provide a relatively large cure-area for heat treatment. As with the heating module 16, the temperature of the cure process 54 is monitored by both the alarm indicating circuit 50 and the temperature controller 46 for alarm and adjustment, respectively. Thus, in this manner, a single system accomplishes high-velocity delivery of hot compressed air against a substrate to promote rapid on-site thermal treatment utilizing portable equipment at a remote site.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A portable compressed air heating system for delivering a flow of heated air directed at a substrate, the system comprising:

a) a hot air distribution member for placement in juxtaposition with the substrate and distributing heated air collected from a heater module disposed upstream therefrom and in airflow communication therewith;

b) a heater module for receiving a continuous volume of air, said heater module comprising an adjustable velocity production element for drawing and delivering heated air to the hot air distribution member and having at least one heating element for electrical-resistance heating of said air;

c) an interface conduit for connecting the heater module to a system controller disposed upstream therefrom, said interface conduit comprising:

i) a temperature monitoring circuit in communication with the interior of the heater module;

ii) an air intake circuit for receiving exterior air;

iii) an air outlet circuit for delivering air to be heated to the heater module;

iv) an air pressure monitoring circuit in communication with the adjustable velocity production element;

v) an air pressure adjuster circuit in communication with the adjustable velocity production element; and vi) a power circuit for carrying electricity to the heater module; and d) a programmable system controller for connection to the interface conduit and comprising:

i) an air-in port for receiving air from the air intake circuit of the interface conduit;

ii) an air-out port for distributing air through the air outlet circuit of the interface conduit;

iii) a heater-power conduit for distributing electricity through the power circuit of the interface conduit to the heater module;

iv) a temperature controller in communication with the temperature monitoring circuit of the interface conduit for measuring and adjusting the temperature of the interior of the heater module;

v) an air pressure monitor in communication with the air pressure monitoring circuit for measuring air pressure of air departing the heater module for the hot air distribution member; and vi) an air pressure adjuster in communication with the air pressure adjuster circuit for regulating velocity and pressure of air departing the heater module for the hot air distribution member.

2. A portable compressed air heating system as claimed in claim 1 wherein the hot air distribution member is a manifold structure.

3. A portable compressed air heating system as claimed in claim 2 wherein the manifold structure has a heat delivery area of about four square feet.

4. A portable compressed air heating system as claimed in claim 1 wherein the heater module further comprises an explosion proof housing.

5. A portable compressed air heating system as claimed in claim 1 wherein the heater module has a plurality of heating elements sufficient to heat said air to a temperature of about 600° F.

6. A portable compressed air heating system as claimed in claim 1 comprising in addition an audible warning signal in communication with the temperature controller and activated when a temperature of the heater module exceeds a selected value.

7. A portable compressed air heating system as claimed in claim 1 wherein the system controller is of a size to be accommodated within a 24-inch suitcase with space remaining therein for storage accommodation of the heater module.

8. A portable compressed air heating system as claimed in claim 1 further comprising an integrated data logger for recording process temperatures.

9. A portable compressed air heating system as claimed in claim 1 wherein the adjustable velocity production element comprises a plurality of adjustable Venturi openings.

10. A portable compressed air heating system as claimed in claim 1 wherein the heating system is operable with 110-volt electrical power.

11. A portable compressed air heating system as claimed in claim 1 wherein the interface conduit is about 20 feet in length.

* * * * *